US007360283B2

(12) United States Patent
Yu

(10) Patent No.: US 7,360,283 B2
(45) Date of Patent: Apr. 22, 2008

(54) BAGGAGE FASTENING DEVICE HAVING AN ANTI-REVERSE FUNCTION

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 140 days.

(21) Appl. No.: 10/998,647

(22) Filed: Nov. 30, 2004

(65) Prior Publication Data

US 2006/0081022 A1 Apr. 20, 2006

(30) Foreign Application Priority Data

Oct. 14, 2004 (TW) ..... 93216366 U

(51) Int. Cl.
*A44B 11/06* (2006.01)

(52) U.S. Cl. ..... 24/171; 24/166; 70/58

(58) Field of Classification Search ..... 24/166, 24/167, 171, 196, 265 BC, 195; 70/58
See application file for complete search history.

(56) References Cited

U.S. PATENT DOCUMENTS 4,912,950 A * 4/1990 Crowle ..... 70/58
5,123,153 A * 6/1992 Krauss ..... 24/196
5,309,610 A * 5/1994 le Gal ..... 24/625
5,417,455 A * 5/1995 Drinane et al. ..... 280/808
5,729,877 A * 3/1998 Kong et al. ..... 24/625
6,016,675 A * 1/2000 Te ..... 70/312
6,647,750 B2 * 11/2003 Kaneko et al. ..... 70/58
2004/0112098 A1 * 6/2004 Bonelli et al. ..... 70/58
2005/0055810 A1 * 3/2005 Loughlin et al. ..... 24/615

* cited by examiner

*Primary Examiner*—James R. Brittain
(74) *Attorney, Agent, or Firm*—Rosenberg, Klein & Lee

(57) ABSTRACT

A baggage fastening device includes a first snapping member, a second snapping member detachably secured on the first snapping member, a strap mounted between the first snapping member and the second snapping member, and a protruding stop member mounted on the first snapping member and extended to a side of the second snapping member. Thus, the stop member restricts movement of the strap, so that the movable portion of the strap cannot be released and moved backward after the baggage is tightened by the strap, thereby preventing the strap from being loosened from the baggage so as to provide an anti-reverse effect to prevent the baggage fastening device from being loosened from the baggage.

3 Claims, 11 Drawing Sheets

BAGGAGE FASTENING DEVICE HAVING AN ANTI-REVERSE FUNCTION

BACKGROUND OF THE INVENTION

1. Field of the Invention

The present invention relates to a baggage fastening device, and more particularly to a baggage fastening device for tightening or loosening a baggage.

2. Description of the Related Art

A conventional baggage fastening device in accordance with the prior art shown in FIGS. 9 and 10 comprises a first snapping member 41, a second snapping member 40 detachably secured on the first snapping member 41 and having a first end formed with a first passage 401 and a second passage 402 spaced from the first passage 401 and a second end detachably inserted into and locked in a first end of the first snapping member 41, and a strap 5 mounted between the first snapping member 41 and the second snapping member 40 and having a first end formed with a fixed portion 50 fixedly attached on a second end of the first snapping member 41 and a second end formed with a movable portion 51 extended through the first passage 401 and the second passage 402 and protruded outward from the first end of the second snapping member 40.

In operation, after the strap 5 of the conventional baggage fastening device is enclosed around a baggage 60, the second snapping member 40 is locked on the first snapping member 41 to lock the baggage fastening device as shown in FIG. 9. Then, the movable portion 51 of the strap 5 is pulled outward and is retained by the second snapping member 40 so as to tighten the strap 5, thereby binding the baggage fastening device on the baggage 60, so that the baggage 60 is fastened and locked by the baggage fastening device to prevent the baggage 6 from being opened.

However, when the first snapping member 41 of the baggage fastening device is driven to move or pivot outward relative to the baggage 60 until the movable portion 51 of the strap 5 is parallel with the strap 5 as shown in FIG. 10, the movable portion 51 of the strap 5 is released from the second snapping member 40, so that the movable portion 51 of the strap 5 is moved backward as indicated by the arrows "B", thereby loosening the strap 5 from the baggage 60. Thus, the baggage fastening device is loosened from the baggage 60 easily, so that the baggage fastening device is inoperative.

The closest prior art references of which the applicant is aware are disclosed in the Taiwanese Patent Publication No. 188582, 457855 and 514121.

SUMMARY OF THE INVENTION

The present invention is to mitigate and/or obviate the disadvantage of the conventional baggage fastening device.

The primary objective of the present invention is to provide a baggage fastening device having an anti-reverse function.

Another objective of the present invention is to provide a baggage fastening device that is not loosened from the baggage after the baggage is tightened by the strap.

A further objective of the present invention is to provide a baggage fastening device, wherein the stop member restricts movement of the strap, so that the movable portion of the strap cannot be released and moved backward after the baggage is tightened by the strap, thereby preventing the strap from being loosened from the baggage so as to provide an anti-reverse effect to prevent the baggage fastening device from being loosened from the baggage.

In accordance with the present invention, there is provided a baggage fastening device, comprising:

a first snapping member;

a second snapping member detachably secured on the first snapping member; and a protruding stop member mounted on the first snapping member and extended to a side of the second snapping member.

Further benefits and advantages of the present invention will become apparent after a careful reading of the detailed description with appropriate reference to the accompanying drawings.

DETAILED DESCRIPTION OF THE INVENTION

Figure 1:
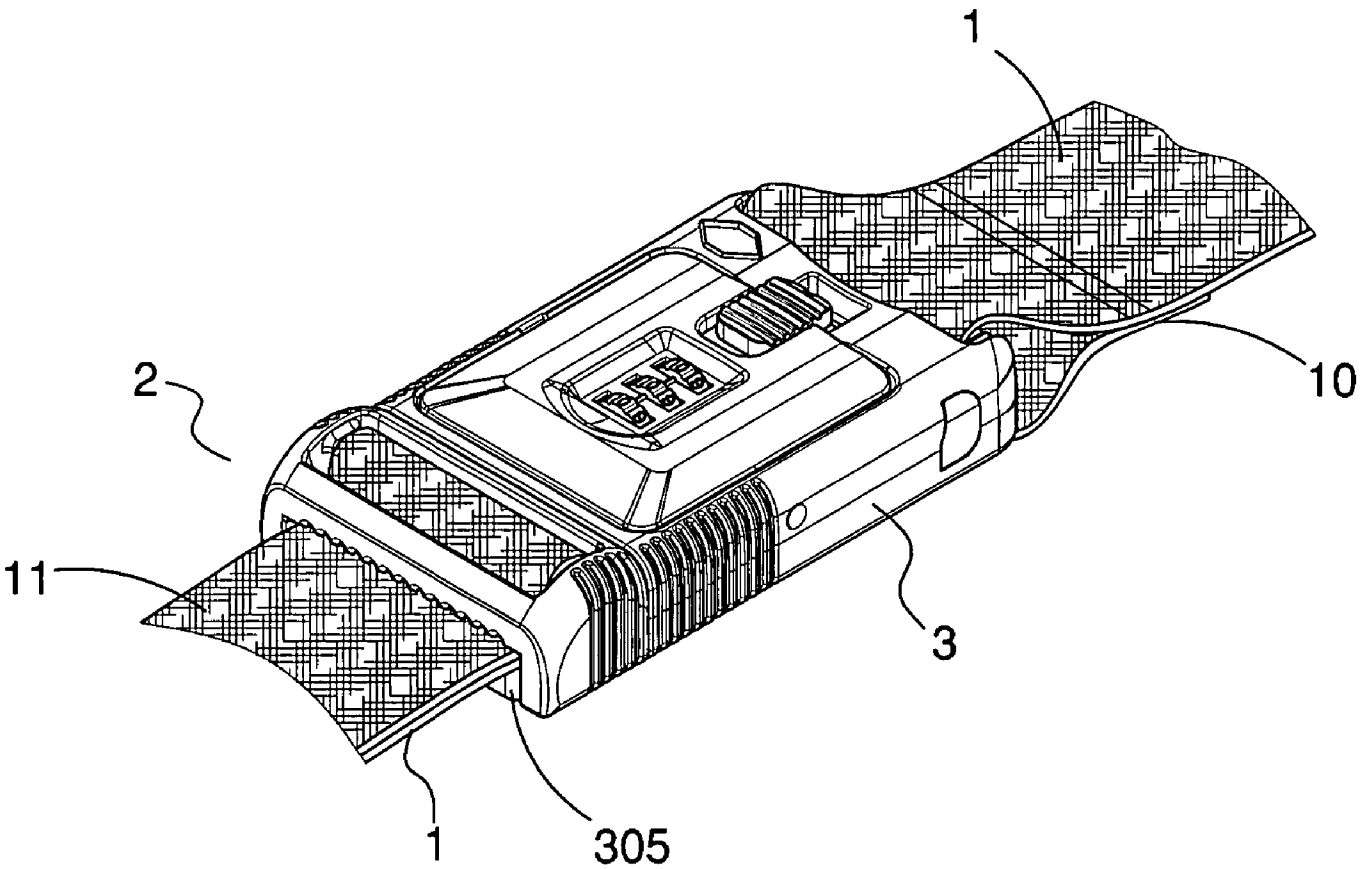
FIG. 1 is a partially cut-away perspective view of a baggage fastening device in accordance with the preferred embodiment of the present invention.
Figure 2:
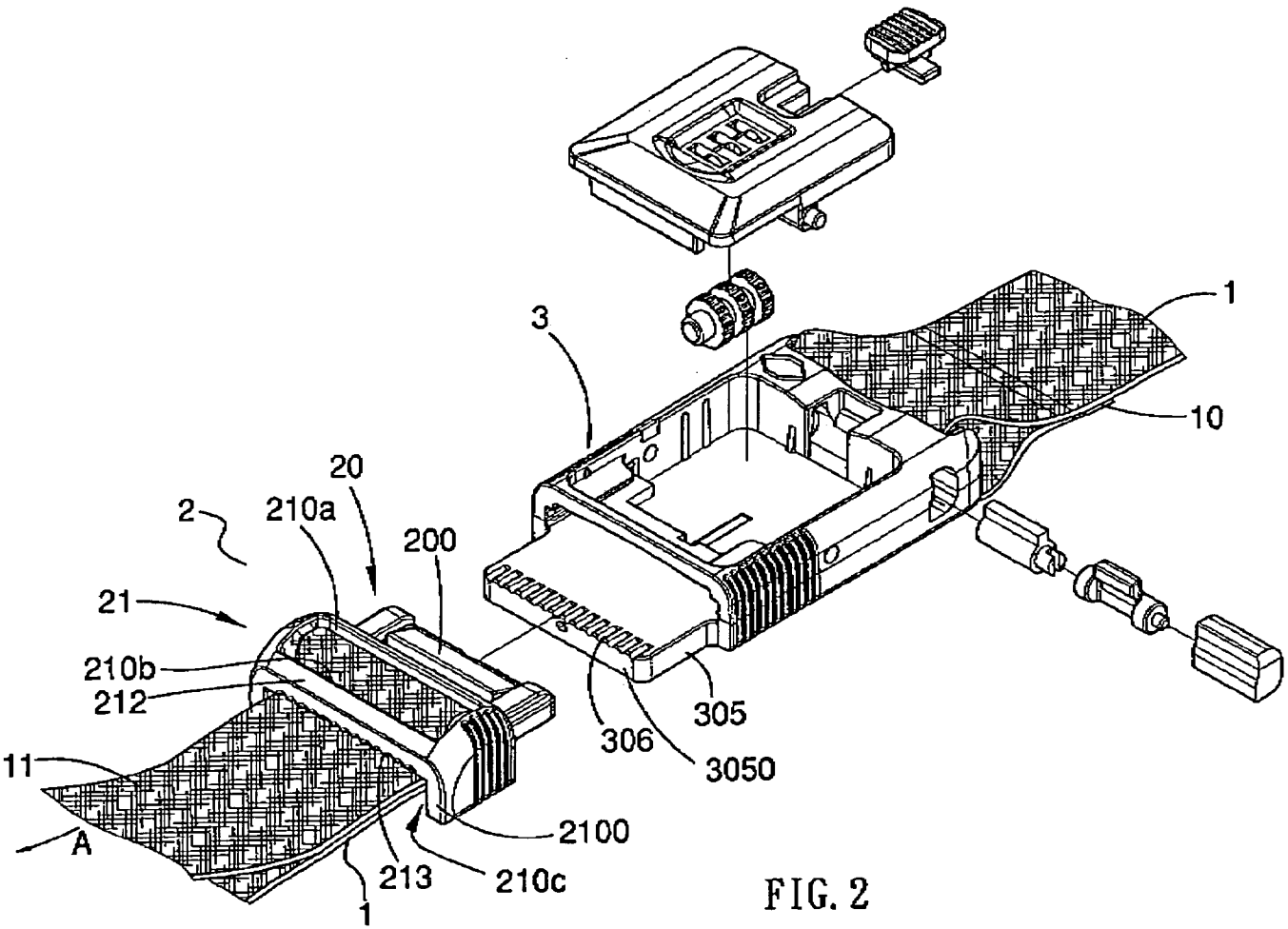
FIG. 2 is an exploded perspective view of the baggage fastening device as shown in FIG. 1.

Referring to the drawings and initially to FIGS. 1-4, a baggage fastening device in accordance with the preferred embodiment of the present invention comprises a first snapping member 3, a second snapping member 2 detachably secured on the first snapping member 3, a strap 1 mounted between the first snapping member 3 and the second snapping member 2, and a protruding stop member 305 mounted on the first snapping member 3 and extended to a side of the second snapping member 2.

The second snapping member 2 has a first end 21 formed with a first passage 210*a* a second passage 210*b* spaced from the first passage 210*a* and a bottom defining a tunnel 210*c* in communication with the first and second passages 210*a*, 210*b*; and a second end 20 formed with a locking hook 200 detachably inserted into and locked in a first end of the first snapping member 3. As can be seen in FIG. 1, the first end 21 of the second snapping member 2 is exposed outside of the first snapping member 3 while the second end 20 of the second snapping member 2 is mainly hidden in the first snapping member 3. In such a fashion, the first end 21 of the second snapping member 2 is in an accessible position to be held by hand.

The strap 1 has a first end formed with a fixed portion 10 fixedly attached on a second end of the first snapping member 3 and a second end formed with a movable portion 11 extended through the first passage 210*a* and the second passage 210*b* and protruded outward from the first end 21 of the second snapping member 2.

Preferably, the first end 21 of the second snapping member 2 is provided with a first crossbar 211 and a second crossbar 212 juxtaposed to the first crossbar 211. The first crossbar 211 has a top higher than a bottom surface 213 of the second crossbar 212. In addition, the first passage 210*a* is formed between the first crossbar 211 and the second end 20 of the second snapping member 2 and the second passage 210*b* is formed between the first crossbar 211 and the second crossbar 212. Thus, the movable portion 11 of the strap us in turn extended through the first passage 210*a*, the first crossbar 211, the second passage 210*b* and the second crossbar 212 and protruded outward from the second crossbar 212 of the first end 21 of the second snapping member 2. In other words, the movable portion 11 of the strap 1 is looped around the first crossbar 211 and is divided into an upper section 111 and a lower section 112 as shown in FIG. 3.

Figure 3:
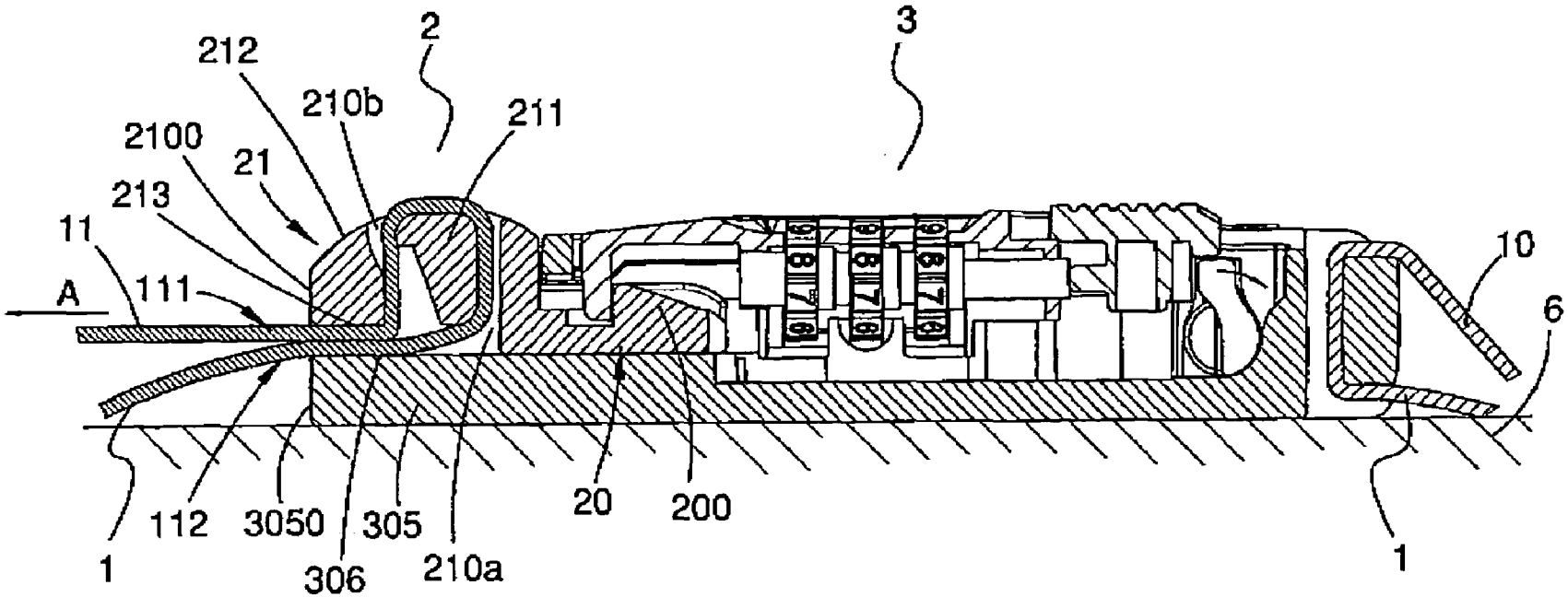
FIG. 3 is a plan cross-sectional view of the baggage fastening device as shown in FIG. 1.

Thus, after the baggage fastening device is mounted on a baggage 6 and is locked as shown in FIG. 3, the upper section 111 of the movable portion 11 of the strap 1 is pulled outward in the direction indicated by the arrow "A" so as to tighten the strap 1, thereby binding the baggage fastening device on the baggage 6, so that the baggage 6 is fastened and locked by the baggage fastening device to prevent the baggage 6 from being opened by a person intentionally.

The stop member 305 is integrally formed on the first snapping member 3 and extended outward from a side of the first snapping member 3. The stop member 305 is complementarily received in the tunnel 210*c* of the first end 21 of the second snapping member 2 with a ton surface 306 parallel to the bottom surface 213 of the second crossbar 212, rested on the strap 1 and located adjacent to the lower section 112 of the movable portion 11 of the strap 1.

Preferably, the stop member 305 is extended to the first end 21 of the second snapping member 2 and located adjacent to the first passage 210*a* of the first end 21 of the second snapping member 2. Alternatively, the stop member 305 is located beyond the first passage 210*a* of the first end 21 of the second snapping member 2. Alternatively, the stop member 305 is located adjacent to the second passage 210*b* of the first end 21 of the second snapping member 2. Alternatively, the stop member 305 is located beyond the second passage 210*b* of the first end 21 of the second snapping member 2. Alternatively, the stop member 305 is extended to the second crossbar 212 of the first end 21 of the second snapping member 2 and has an end face 3050 aligning with an end face 2100 of the first end 21 of the second snapping member 2. In such a fashion, the lower section 112 is laid on the stop member 305 and both the upper and lower sections 111, 112 of the strap 1 are levelly, firmly sandwiched between the second crossbar 212 and the stop member 305, as depicted in FIGS. 1 and 3.

The stop member 305 has a side formed with a plurality of grooves 306, and the first end 21 of the second snapping member 2 has a side formed with a plurality of protrusions 213 aligning with the grooves 306 of the stop member 305 to provide a restriction to the strap 1.

In operation, after the strap 1 of the baggage fastening device is enclosed around the baggage 6, the second snapping member 2 is locked on the first snapping member 3 to lock the baggage fastening device as shown in FIG. 3. Then, the movable portion 11 of the strap 1 is pulled outward in the direction indicated by the arrow "A" and is retained by the second crossbar 212 of the first end 21 of the second snapping member 2 so as to tighten the strap 1, thereby binding the baggage fastening device on the baggage 6, so that the baggage 6 is fastened and locked by the baggage fastening device to prevent the baggage 6 from being opened by a person intentionally.

Figure 3A:
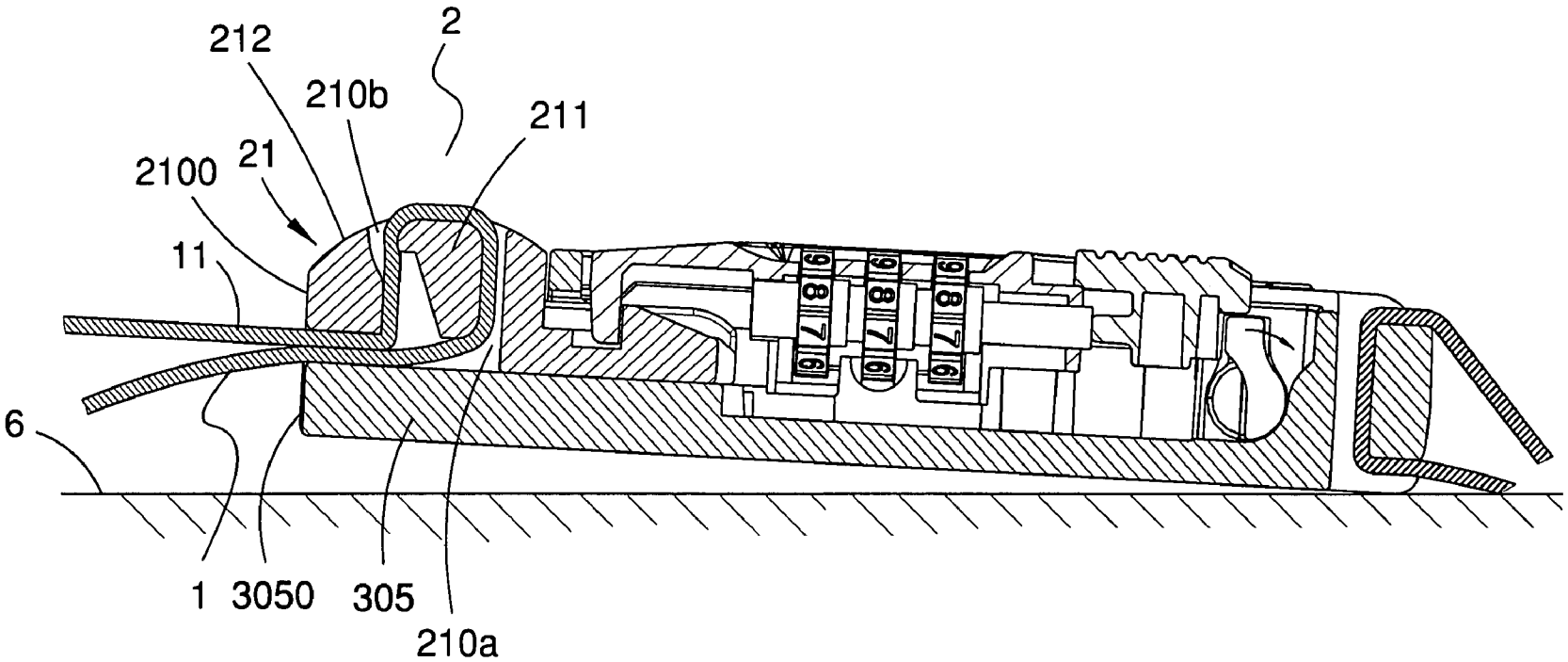
FIG. 3A is a schematic operational view of the baggage fastening device as shown in FIG. 3.
Figure 4:
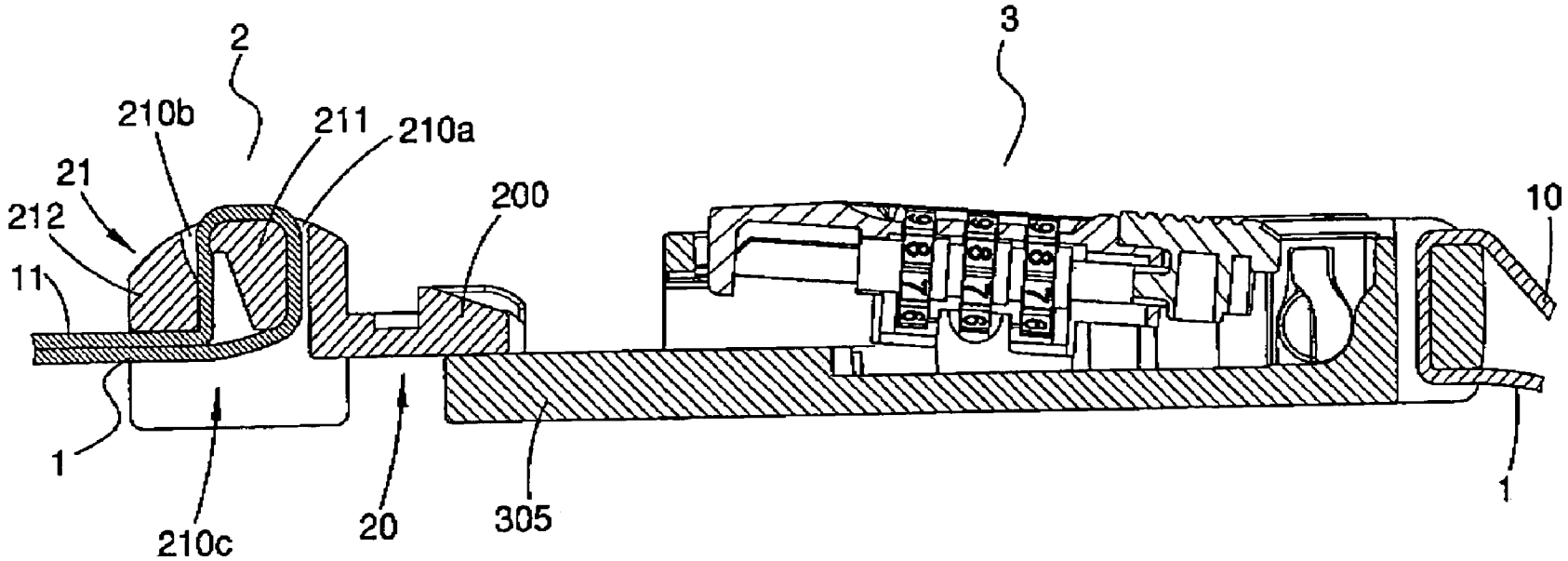
FIG. 4 is a plan cross-sectional exploded view of the baggage fastening device as shown in FIG. 3.

In such a manner, the stop member 305 is extended to the second crossbar 212 of the first end 21 of the second snapping member 2 and is rested on the strap 1, so that movement of the strap 1 is restricted by the stop member 305. Thus, when the baggage fastening device is driven to move or pivot outward relative to the baggage 6 as shown in FIG. 3A, movement of the strap 1 is restricted by the stop member 305, so that the movable portion 11 of the strap 1 cannot be released from the second snapping member 2 and cannot be moved backward by pulling the strap 1, thereby preventing the strap 1 from being loosened from the baggage 6 so as to provide an anti-reverse effect to prevent the baggage fastening device from being loosened from the baggage 6.

Accordingly, the stop member 305 restricts movement of the strap 1, so that the movable portion 11 of the strap 1 cannot be released and moved backward after the baggage 6 is tightened by the strap 1, thereby preventing the strap 1 from being loosened from the baggage 6 so as to provide an anti-reverse effect to prevent the baggage fastening device from being loosened from the baggage 6.

Figure 5:
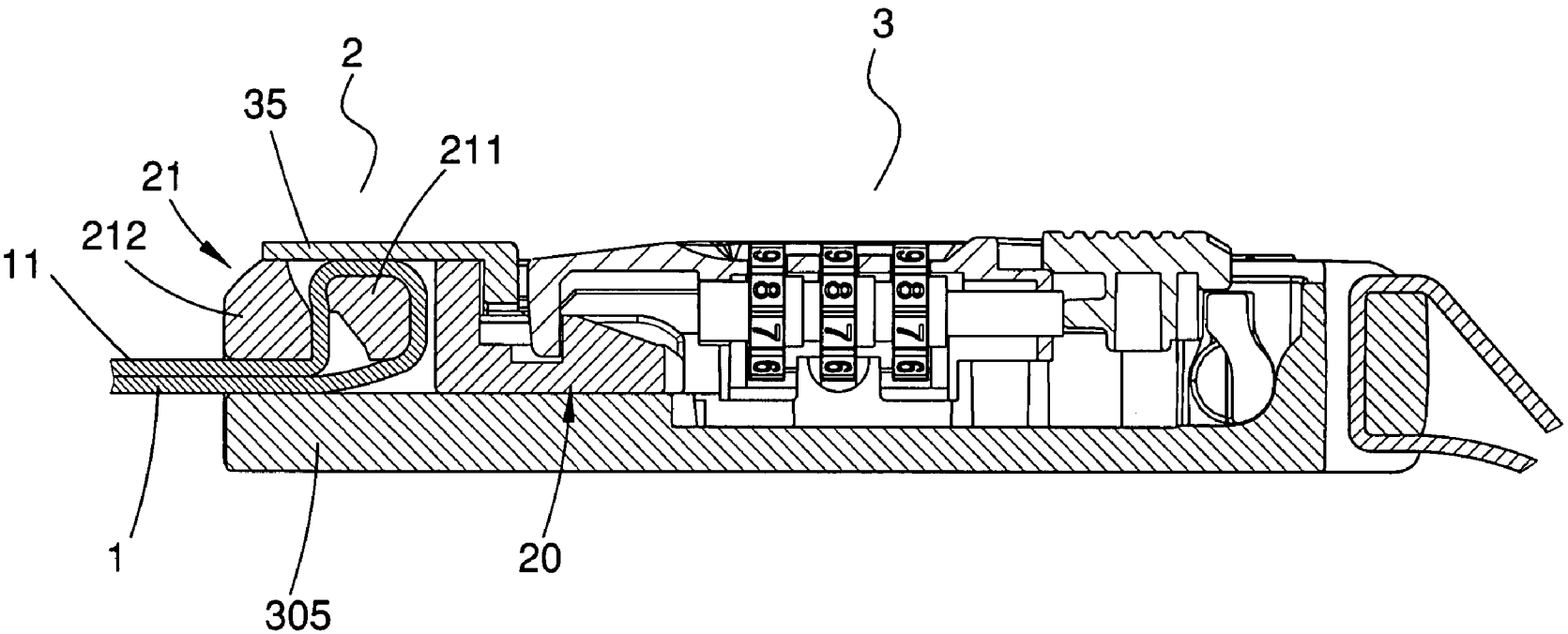
FIG. 5 is a plan cross-sectional view of a baggage fastening device in accordance with another embodiment of the present invention.

Referring to FIG. 5, the baggage fastening device further comprises a cover plate 35 mounted on the first snapping member 3 and extended to a second side of the second snapping member 2. The cover plate 35 is integrally formed on the first snapping member 3 and extended outward from a second side of the first snapping member 3. The cover plate 35 is located opposite to the stop member 305 and is rested on the strap 1. Preferably, the cover plate 35 is extended to the first end 21 of the second snapping member 2 and located beyond the first crossbar 211 of the first end 21 of the second snapping member 2.

Figure 6:
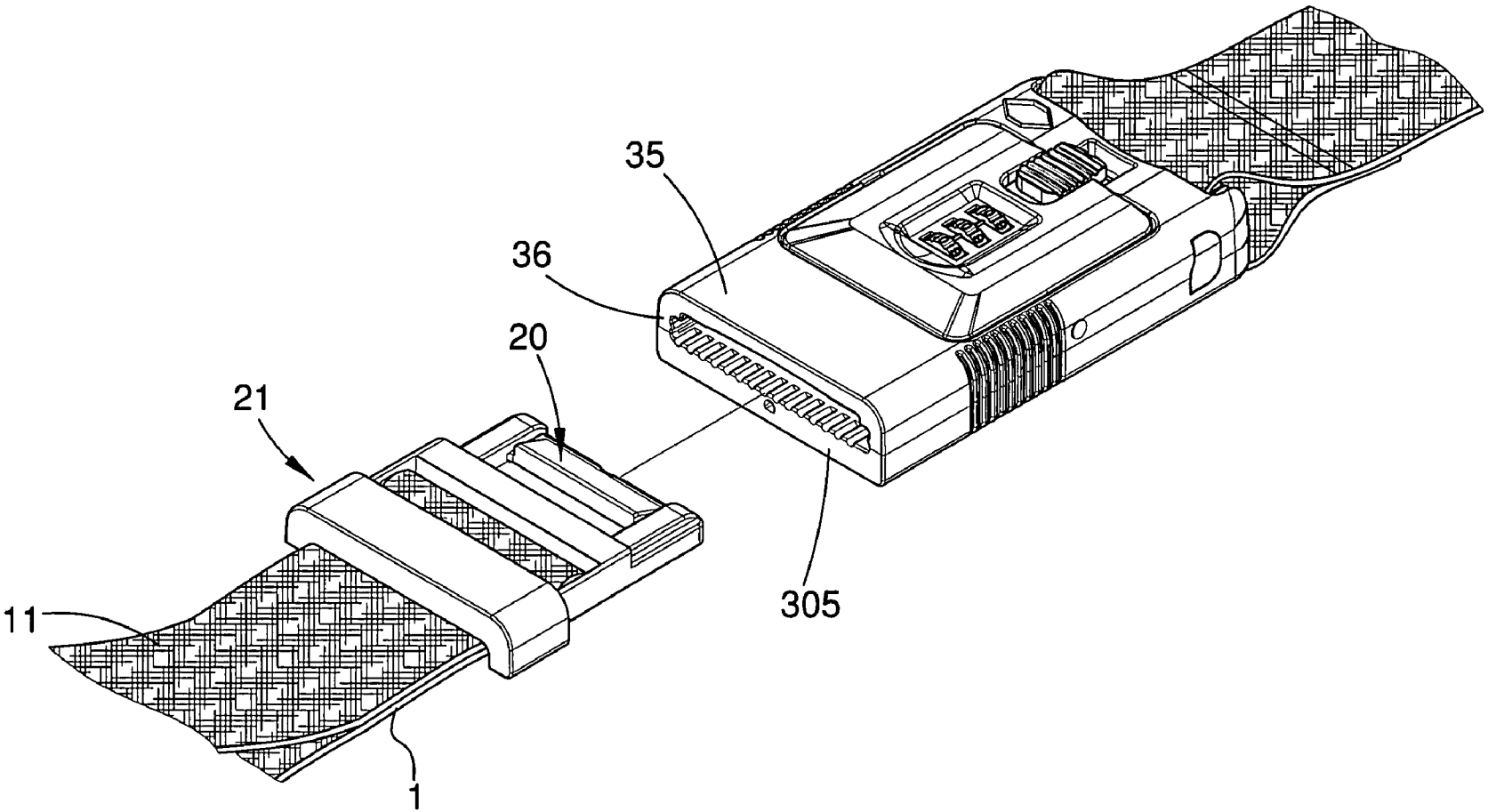
FIG. 6 is a partially cut-away perspective view of a baggage fastening device in accordance with another embodiment of the present invention.
Figure 7:
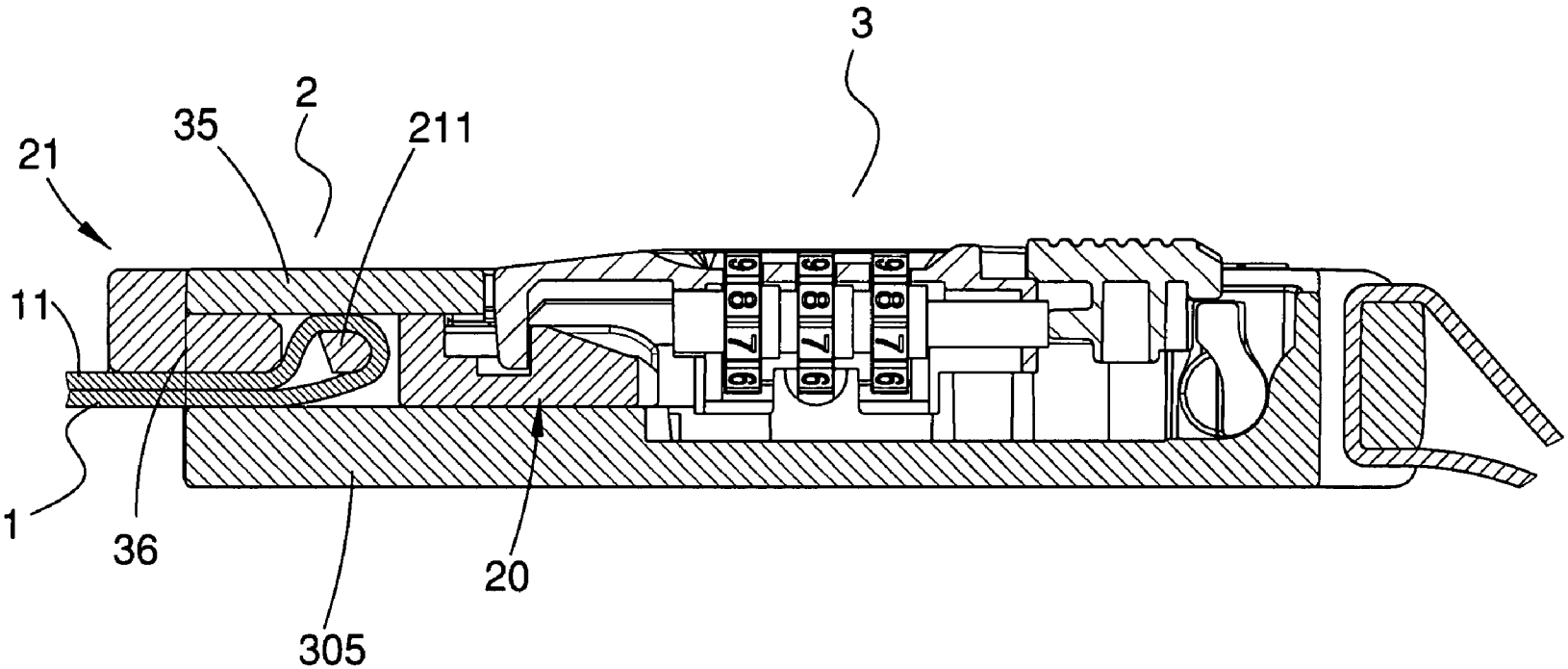
FIG. 7 is a plan cross-sectional view of the baggage fastening device as shown in FIG. 6.

Referring to FIGS. 6 and 7, the baggage fastening device further comprises two side plates 36 mounted on the first snapping member 3 and located between the cover plate 35 and the stop member 305. Preferably, the two side plates 36 are integrally formed on and extended outward from the first snapping member 3.

Figure 8:
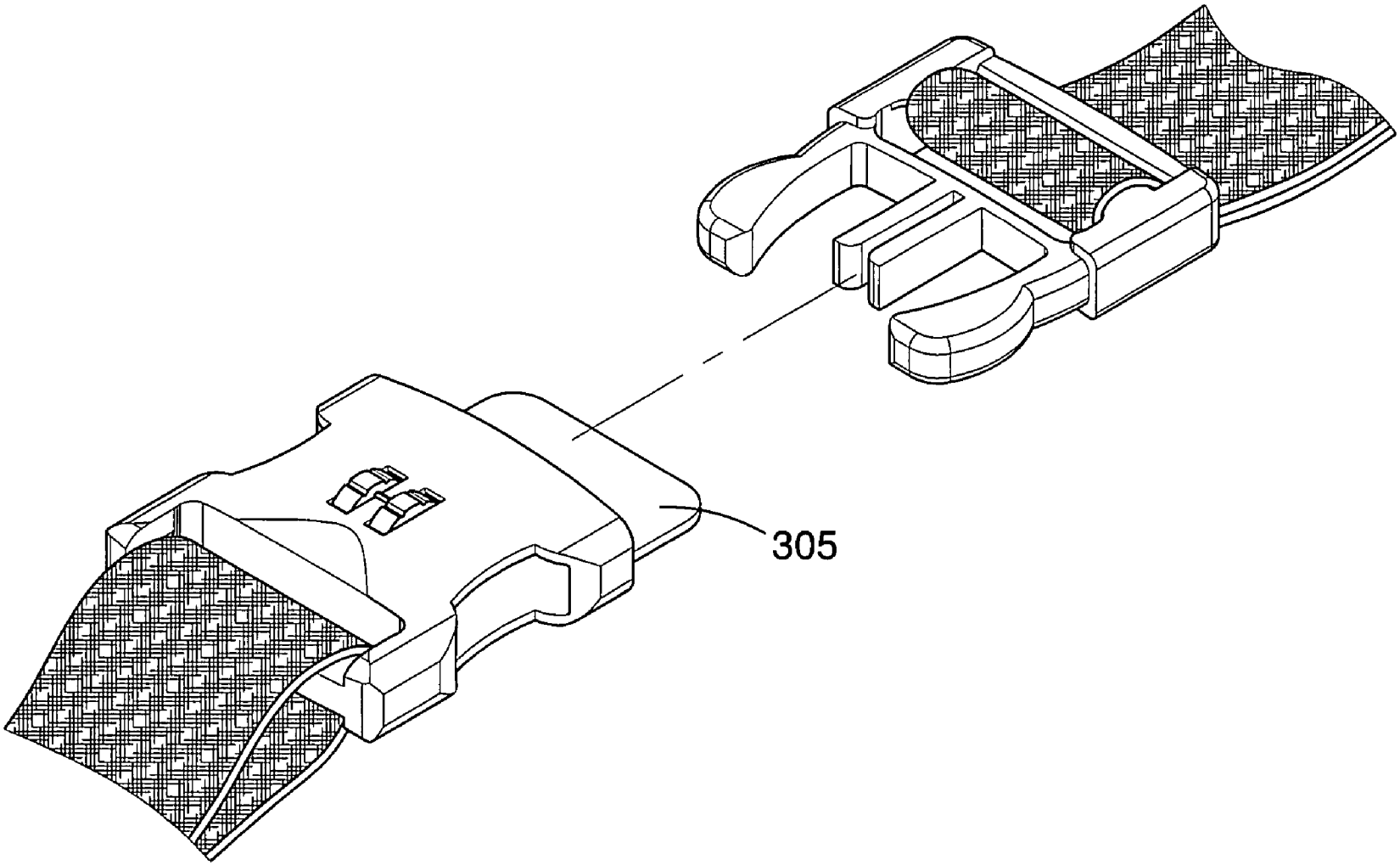
FIG. 8 is a partially cut-away perspective view of a baggage fastening device in accordance with another embodiment of the present invention.
Figure 9:
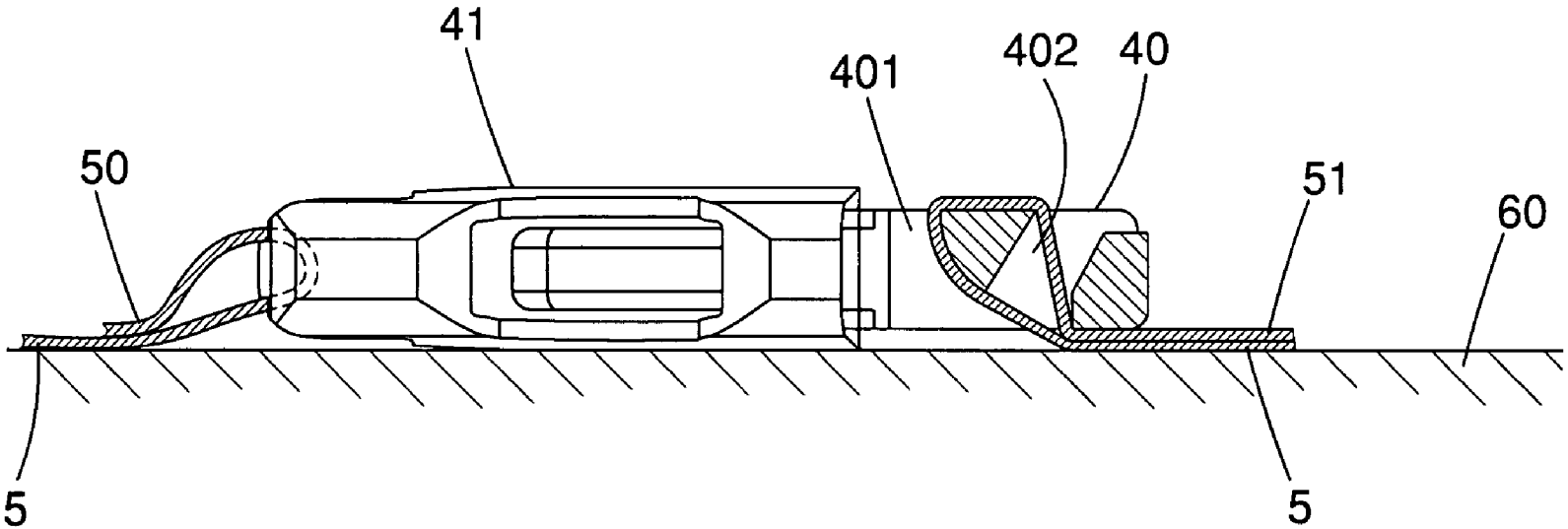
FIG. 9 PRIOR ART
FIG. 9 is a plan cross-sectional assembly view of a conventional baggage fastening device in accordance with the prior art.
Figure 10:
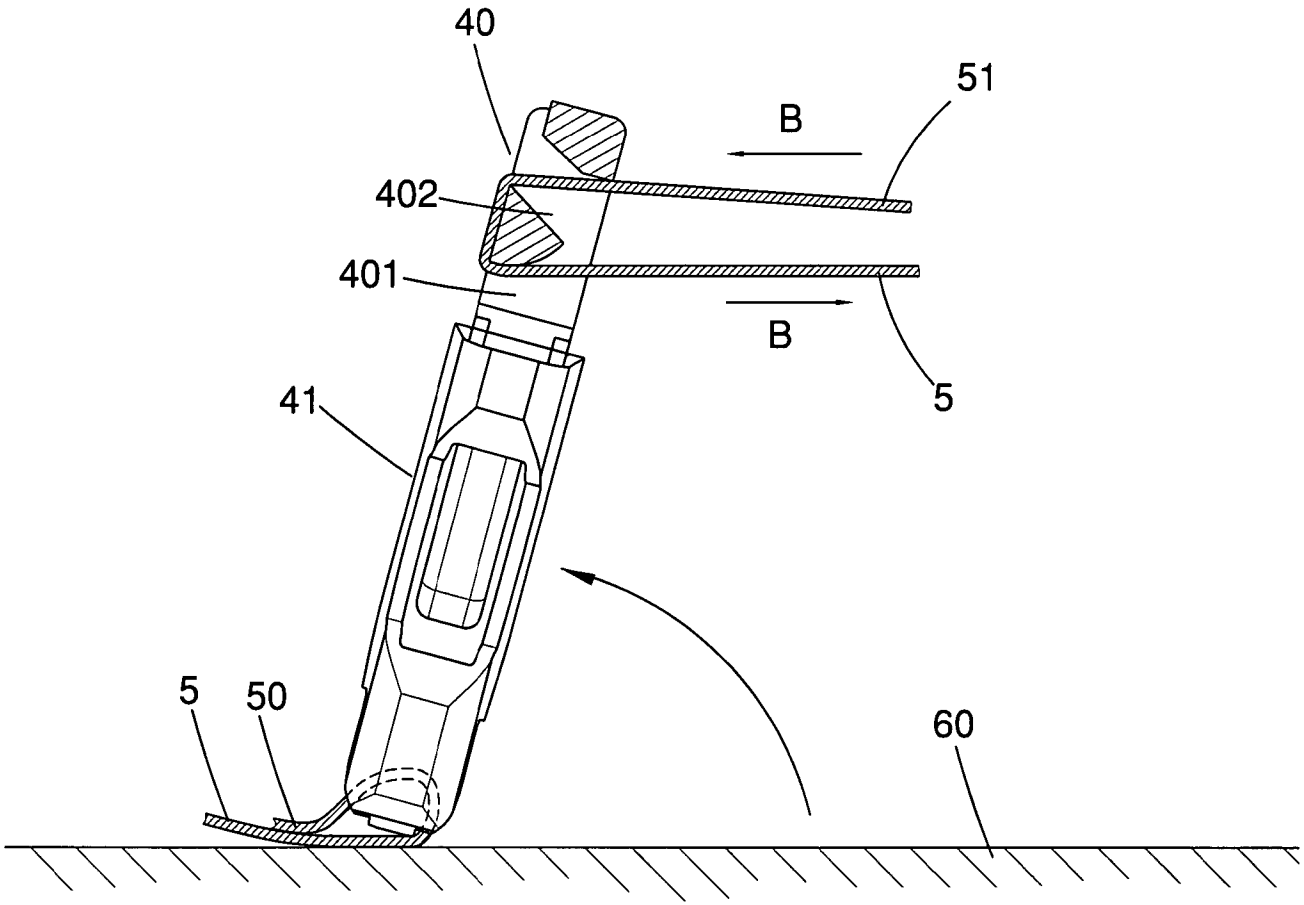
FIG. 10 PRIOR ART
FIG. 10 is a schematic operational view of the conventional baggage fastening device as shown in FIG. 9.

Referring to FIG. 8, the baggage fastening device has a different shape.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A baggage fastening device, comprising:

a first snapping member;

a second snapping member comprising a first end formed with a first crossbar and a second crossbar juxtaposed to the first crossbar wherein the first crossbar has a top higher than a bottom surface of the second crossbar, and a second end detachably secured on the first snapping member; the first end including a first passage defined between the second end and the first crossbar, a second passage defined between the first and second crossbars, and a bottom defining a tunnel in communication with the first and second passages;

a strap comprising a first end connected with an end of the first snapping member and a second end formed with a movable portion passing through the first and second passages of the first end of the second snapping member to be looped around the first crossbar and to be divided into an upper section and a lower section; and a stop member extending from a side of the first snapping member, wherein when the first snapping member is secured on the second snapping members, the stop member is complementarily received in the tunnel with a top surface parallel to the bottom surface of the second crossbar such that the lower section of the movable portion of the strap is laid on the stop member and both the lower and upper sections are firmly sandwiched between the second crossbar and the stop member.

2. The baggage fastening device in accordance with claim 1, wherein the second end of the second snapping member is formed with a locking hook detachably inserted into and locked in the other end of the first snapping member.

3. The baggage fastening device in accordance with claim 2, wherein the first end of the second snapping member is exposed outside of the first snapping member.

* * * * *